US005575169A

United States Patent [19]

Banse

[11] Patent Number: 5,575,169

[45] Date of Patent: Nov. 19, 1996

[54] SHEET METAL BENDING TOOL AND METHOD FOR ACCOMPLISHING THE SAME

[76] Inventor: William J. Banse, 11332 Rolling Hills Dr., Dublin, Calif. 94568

[21] Appl. No.: 344,338

[22] Filed: Nov. 22, 1994

[51] Int. Cl.[6] ..... B21D 5/04

[52] U.S. Cl. ..... 72/319

[58] Field of Search ..... 72/319, 320, 310, 72/308, 305, 316

[56] References Cited

U.S. PATENT DOCUMENTS

| | | | |
|---|---|---|---|
| 93,194 | 8/1869 | Grim . | |
| 118,090 | 8/1871 | Yaesche . | |
| 283,291 | 8/1883 | Snowden | 72/310 |
| 308,349 | 11/1884 | Fairchild . | |
| 316,461 | 4/1885 | Huber . | |
| 590,264 | 9/1897 | Irons . | |
| 671,312 | 4/1901 | Delachartre . | |
| 2,422,042 | 6/1947 | Roberts . | |
| 3,350,912 | 11/1967 | Smith | 72/319 |
| 3,584,492 | 6/1971 | Dodge | 72/310 |
| 4,191,043 | 3/1980 | Schaffer | 72/319 |
| 5,083,355 | 1/1992 | Dacey, Jr. | 72/319 |

FOREIGN PATENT DOCUMENTS

| | | | |
|---|---|---|---|
| 1160798 | 8/1958 | France | 72/310 |
| 46785 | 12/1978 | Japan | 72/319 |
| 108325 | 8/1943 | Sweden | 72/319 |
| 148944 | 2/1955 | Sweden | 72/320 |
| 3677 | 7/1907 | United Kingdom | 72/319 |
| 646859 | 11/1950 | United Kingdom | 72/320 |

*Primary Examiner*—Daniel C. Crane

*Attorney, Agent, or Firm*—Kolisch, Hartwell, Dickinson, McCormack & Heuser

[57] ABSTRACT

A sheet metal bending tool including a base defining a work area, a confronting member mounted on the base adjacent the work area for biasing a portion of the sheet metal against the base, and a bending member rotatably mounted to the base and spaced from the confronting member for rotatably bending an end portion of the sheet metal and a method for accomplishing the same are described.

23 Claims, 5 Drawing Sheets

FIG. 4D
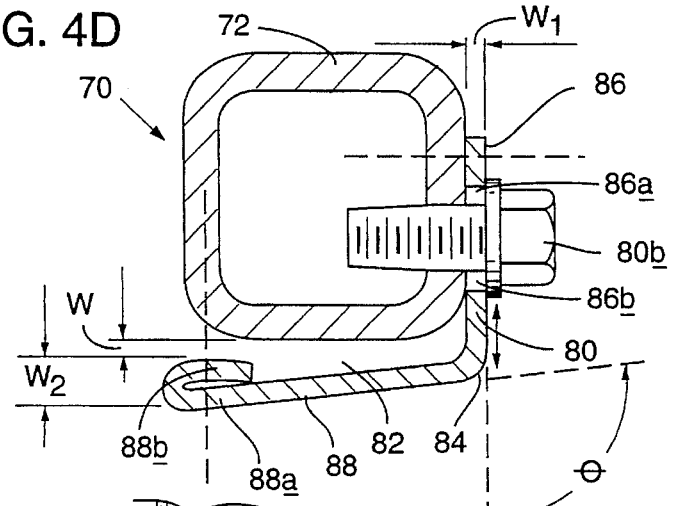
FIG. 5
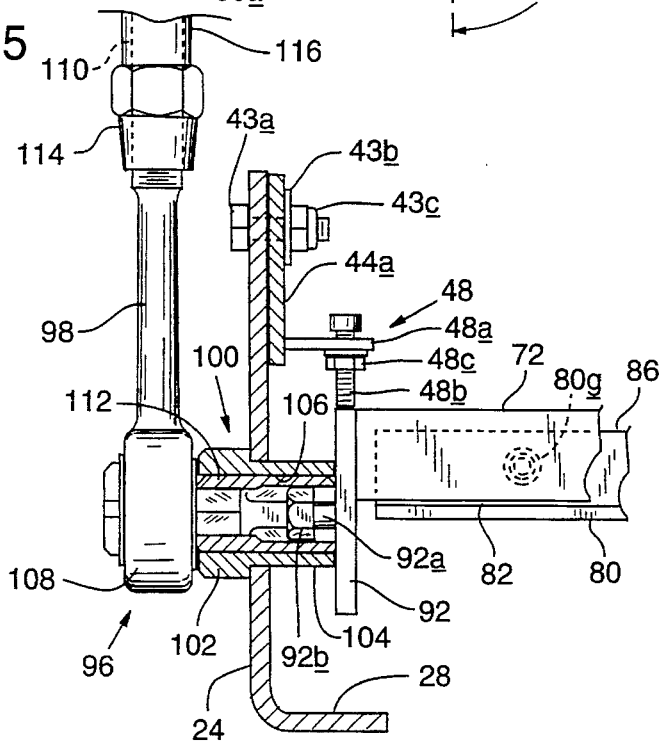
FIG. 6A
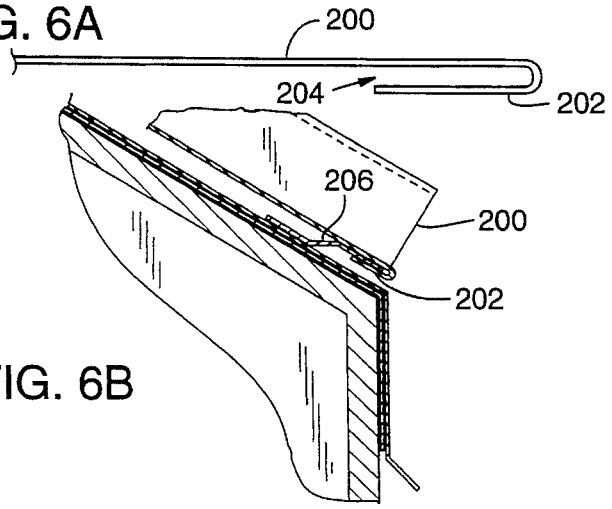
FIG. 6B

SHEET METAL BENDING TOOL AND METHOD FOR ACCOMPLISHING THE SAME

BACKGROUND AND SUMARRY OF THE INVENTION

The present invention relates generally to a tool for bending sheet metal and more particularly to a tool for hemming architectural sheet metal roof panels.

In the construction industry and particularly the roofing industry, it has become customary to install sheet metal panels on the roofs of certain buildings. These panels have become very popular insofar as their ease of installation and the protection they provide against the elements. Moreover, when properly installed, the metal panels add greatly to the aesthetic appearance of the building.

The typical panel is elongate and includes a flat portion with opposed side walls attached thereto which extend orthogonally away therefrom. A flange is attached to the flat portion and defines a leading edge. When installed, each panel lies adjacent one another with a side wall of each joined to a side wall of an adjacent panel by a U-shaped panel clip which fits around a portion of both sidewalls and is anchored to the roof by two flange extensions.

The flange defining the leading edge of the panel is usually given a 180° U-shaped bend wherein such bend defines an elongate recess. A joggle cleat installed on the roof includes a flat edge portion which is received in the recess defined by the bent flange portion on the panel. More specifically, when the joggle cleat is installed on the roof, a first portion is fastened to the roof. The flat edge extends away from the first portion and is separated from the roof by a small space. The 180° bend in the panel's flange is designed to receive the flat edge of the joggle cleat. Thereafter, successive panels may be secured to one another by the aforementioned panel clip.

The 180° bend in the flange defining the panel's leading edge is a standard feature in sheet metal roof panels. That is, it is customary to form such a bend or hook as it is sometimes called, before installing the panels on the roof. Heretofore in the industry, such bending has been accomplished via simple handheld bending tools such as pliers or crimping tools. These tools require varying degrees of skill and effort by the workman, depending on the thickness of the material used and the panel width.

Typically, a worker will physically clamp or grip the flange defining the leading edge with the tool and turn it under to form the bend. Consistent problems attendant with the use of these tools is that uniform bends depend upon the skill of the individual workman. Moreover, the process of applying such bends to the leading edge flange of the panel usually requires two workmen, one to hold the panel and the other to use the bending tool. During such operation, tearing fractures often occur in the panel's flange due to unevenly applied stresses. Further, panels must often be inverted to perform the bending operation and then turned back over for installation which can be cumbersome with longer roof panels. Needless to say, this whole process is very time consuming and can end up costing the builder and hence the owner a great deal of money.

Although a number of devices for bending sheet metal are known, such devices are limited in utility because they either fail to provide a means for securing the workpiece during the bending operation or they do not provide a 180° bend in the flange portion. One such device is disclosed in U.S. Pat. No. 4,191,043, entitled "METAL DUCT DRIVE BENDING TOOL," issued to Schaffer. Schaffer discloses a triangularly shaped duct bending tool having a handle and a support member. The handle is connected via a hinge to the support member and includes a slot into which a piece of sheet metal fits for subsequent bending. Plural teeth are provided on the handle to exert bending pressure on the sheet metal when the handle and support member are separated and used to bend the metal. Schaffer does not disclose the use of any structure to confine the workpiece or sheet metal to the slot during the bending thereof. Rather, the user must physically bias the tool against the workpiece when bending it. Moreover, although the tool allows for a 180° bend in the metal, its utility is severely limited by the gauge of the metal sought to be bent. For instance, the tool disclosed in Schaffer would be ineffective in bending a workpiece consisting of a thicker gauge metal because the user must directly physically bend the workpiece with the tool. Schaffer provides no means for the user to leverage their strength and bend thicker gauge metals. Furthermore, the bending of the metal workpiece is necessarily complicated by the fact that the user must ensure that the sheet metal stays within the slot during the bending operation by physically biasing the tool against the workpiece. On longer workpieces, this would necessarily require two people.

Thus, significant problems with the prior art metal bending tools are that generally, more than one person is required to operate the tool. This is especially so when the workpiece is longer such as a roof panel. Another problem with the prior art metal bending tools of the type which may be operated by one person is that such tools are necessarily limited in utility by the gauge or thickness of the metal sought to be bent. The thicker the sheet metal, the less likely that one person is going to be able to physically bend it. Moreover, uniform bends and stress tears in the metal are all problems which the prior art fails to fully solve.

With the above problems in mind, it is a general object of the invention to provide a tool for bending sheet metal which can operated by one person without regard to the gauge or thickness of metal sought to be bent.

It is another object of the invention to provide a tool for bending sheet metal which provides a means for holding the sheet metal in place during the bending operation.

It is a further object of the invention to provide a tool for bending sheet metal which reduces the chance of stress tears due to non-uniform bending.

It is yet another object of the invention to provide a tool for bending sheet metal which is small and portable and which may be used at a variety of sites.

It is yet a further object of the invention to provide a tool for bending sheet metal which is inexpensive to manufacture, easy to use and reduces the skill necessary to operate it.

In brief summary, the invention achieves these and other objects in the form of a sheet metal bending tool for use in bending an end portion of a piece of sheet metal which tool includes a base defining a sheet metal work area into which a workpiece may be inserted, a confronting member mounted on the base adjacent the work area and reciprocally movable relative to the base for biasing or pressing a portion of the workpiece against the base to fix its position, and a bending member rotatably mounted to the base and spaced from the confronting member for bending an end portion of the sheet metal. In the preferred embodiment, an elongate slot is provided on the bending member for receiving an end portion of the workpiece and thereafter allowing for the uniform bending of the portion. Structure within the slot allows for the overbending or overbreaking of the end portion to counter the workpiece's inherent resiliency. The slot is adjustable for accommodating metals of differing gauges or thicknesses. The bending member is also provided with a ratcheting feature which allows for reciprocal incremental bending of the workpiece. A method for accomplishing the same is also described.

These and other objects and advantages of the invention will become more fully apparent when the detailed description below is read with reference to the accompanying drawings.

DESCRIPTION OF THE DRAWINGS

FIGS. 4A–D are enlarged side views of a bending member of the present invention.

FIG. 5 is rear elevation of the bending tool taken along line 5—5 of FIG. 3.

FIG. 6A is a side view of a portion of sheet metal bent into a "J-hook."

FIG. 6B is a side view of a sheet metal roof panel as it appears installed on a roof.

DETAILED DESCRIPTION OF THE PREFERRED EMBODIMENT

Figure 1:
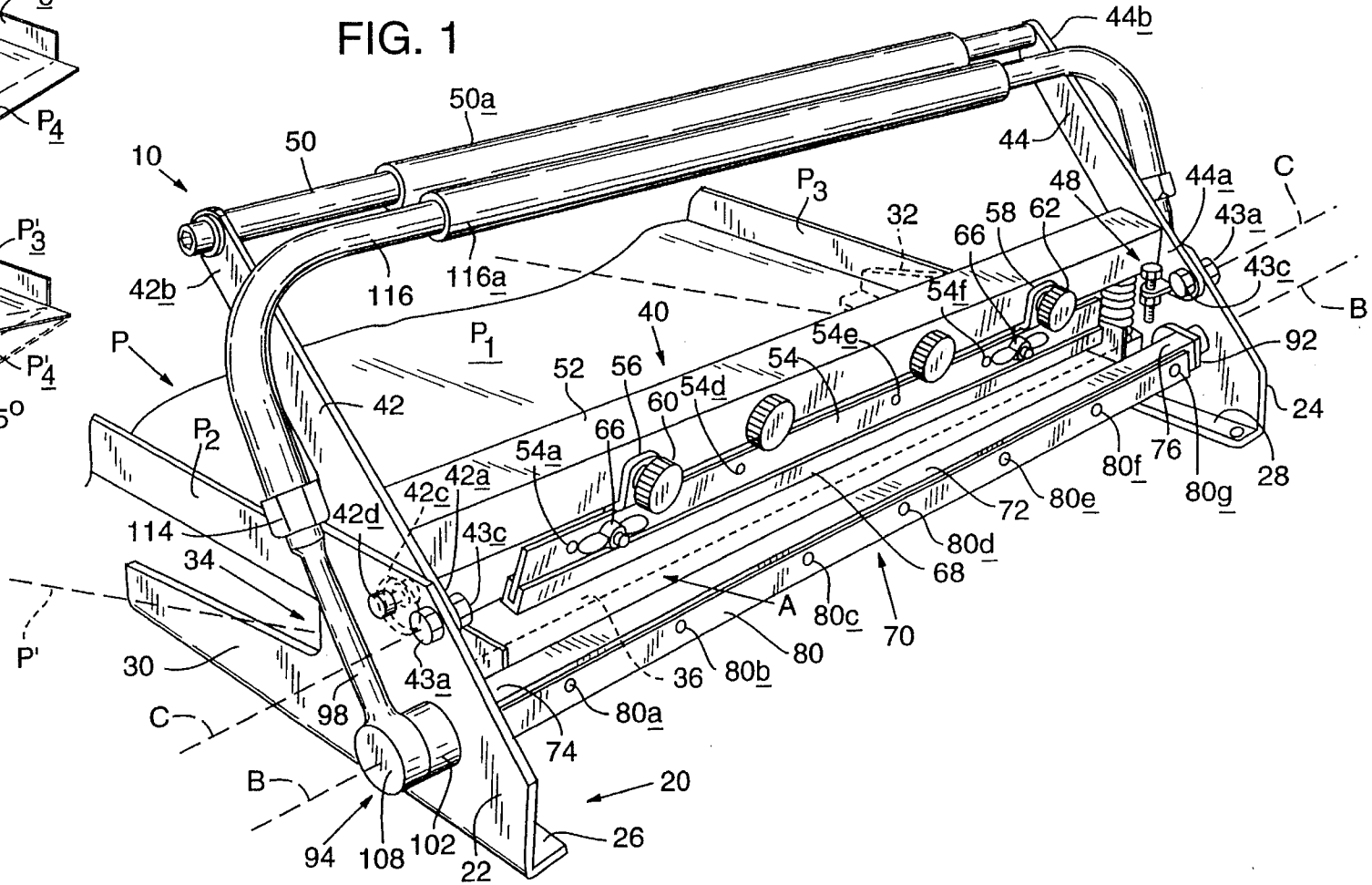
FIG. 1 is an isometric view of a bending tool constructed according to the invention.

A bending tool for hemming sheet metal roof panels, constructed according to the present invention is shown in FIG. 1 generally at 10. Tool 10 includes a support base 20 defining a sheet metal work area A, a confronting member 40 rotatably mounted on base 20 adjacent work area A and rotatable about an axis C for reciprocal movement relative to the base, and a bending member 70 rotatably mounted to base 20 and spaced from confronting member 40, wherein the bending member is rotatable about a rotation axis B which is substantially parallel to axis C. Put another way, axis B, the first axis, is substantially parallel to axis C, the second axis.

Figure 1A:
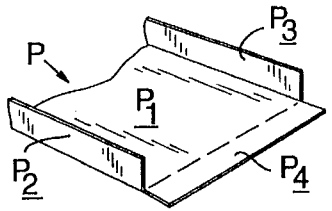
Fig. 1*a* is an isometric view of a sheet metal roof panel.

FIG. 1*a* shows a piece of sheet metal in the form of a roof panel generally indicated at P. Panel P, also referred to as a workpiece, has a generally rectangular flat portion $P_1$, which may be cut to any desired length, depending on the dimensions of the roof on which installation is intended, and two opposed side walls $P_2$ and $P_3$, each formed at a long side of the panel and extending upwardly therefrom. A flange $P_4$ extends from portion $P_1$, defining the leading edge of panel P.

Figure 1B:
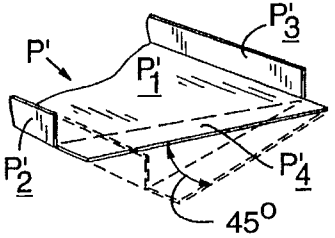
Fig. 1*b* is an isometric view of a sheet metal roof panel known as a valley panel.

FIG. 1*b* shows a valley panel P' which has a flat angled portion P' with two opposed side walls $P_2'$ and $P_3'$ each formed at a long side of the valley panel which extend upwardly therefrom. A flange $P_4'$ extends from portion $P_1'$ and defines the leading edge of panel P'. Valley panel P' is different than panel P because it is installed at, and forms a portion of a corner on a roof. Such installation requires that each panel have at the roof's corner, an angled leading edge like $P_4'$ which comes together with a similarly angled leading edge on another panel to form a portion of the corner.

FIG. 1 shows workpiece P' inserted into tool 10 with a portion thereof occupying work area A. Workpiece P' in phantom lines is shown inserted into tool 10 at somewhat of an offset angle which is described in more detail below.

Figure 2:
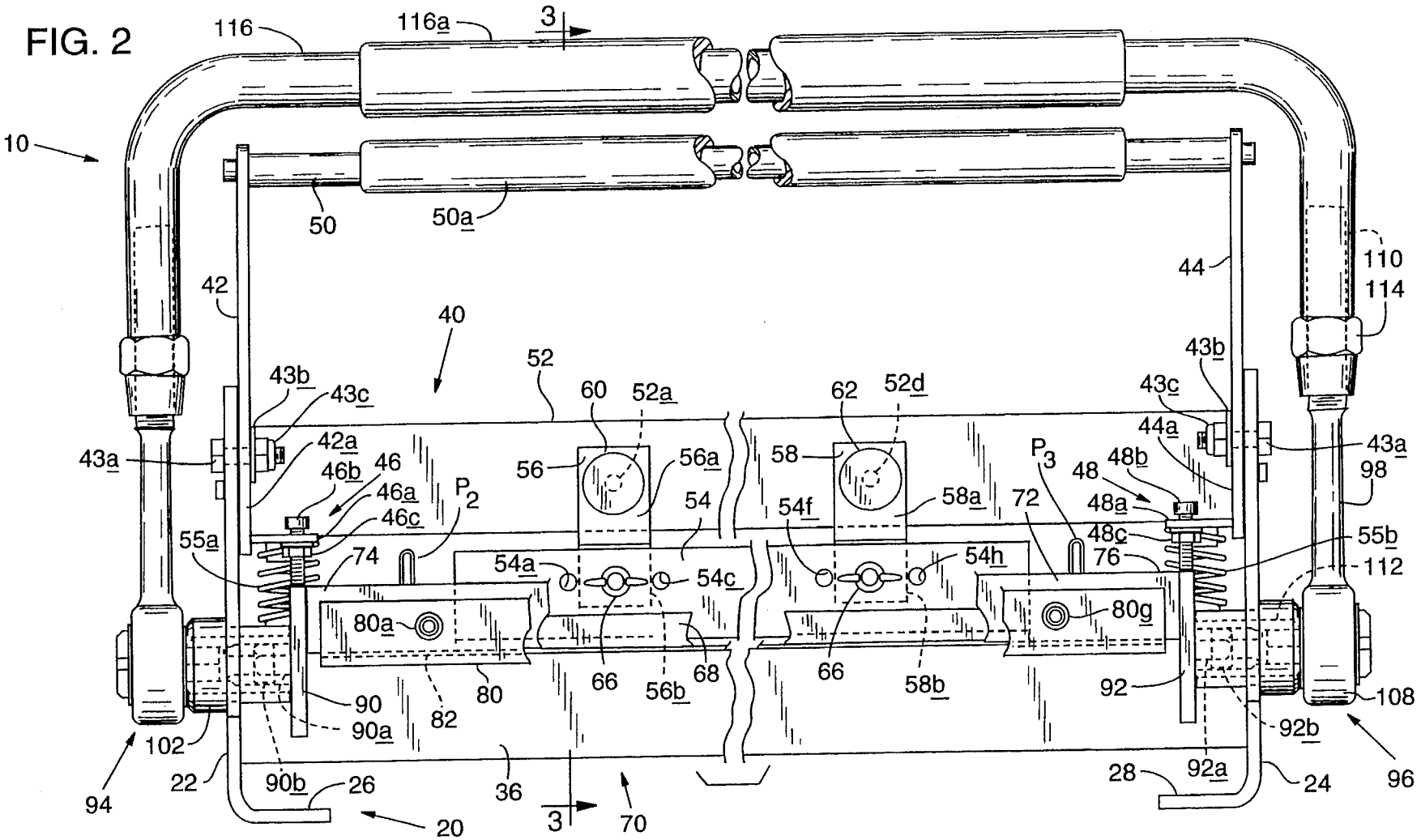
FIG. 2 is a front elevation of the bending tool.
Figure 3:
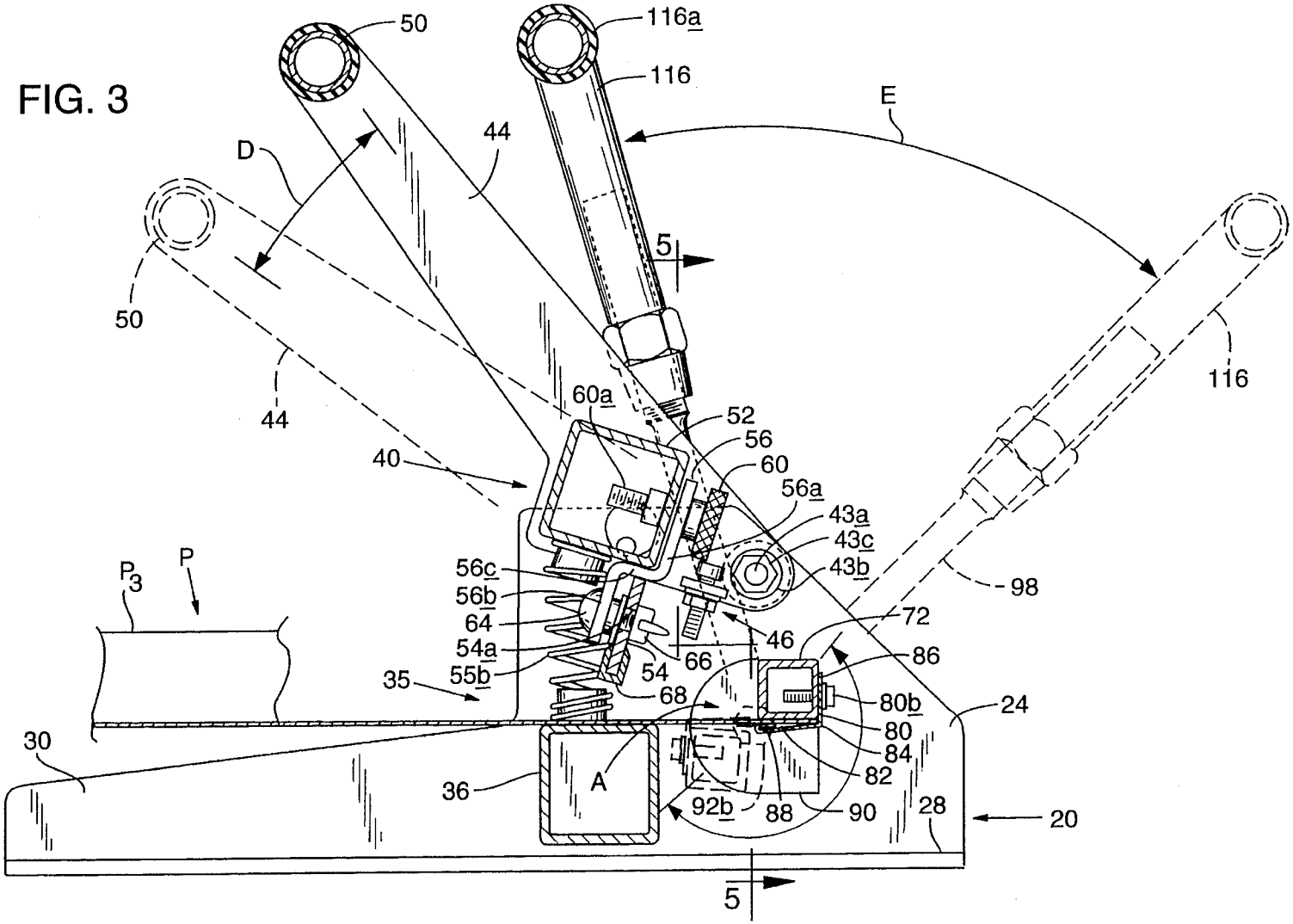
FIG. 3 is a side elevation of the bending tool taken along line 3—3 of FIG. 2.

Base 20, preferably constructed of stainless steel, is shown in FIGS. 1–3 and has two upwardly extending walls 22 and 24 with inwardly extending shoulders 26 and 28, respectively. Wall 22 has a rear portion 30 with a recess 34 and wall 24 has a rear portion 32 with a similar recess 35, most easily seen in FIG. 3. An elongate support bar 36 is preferably hollow and joins walls 22 and 24 to define a sheet metal work area A. The bar may be joined by any conventional means, however in the preferred embodiment, it is welded to both walls. Bar 36 has a square cross-section transverse the long axis thereof which is most easily seen in FIG. 3. One side of the bar provides a generally flattened surface against which workpiece P or P' is pressed during the bending thereof described below. Given this, the support bar may assume different shapes and have varied cross-sections which are all within the scope of the invention. The importance with respect to the different shapes and varied cross-sections which the bar may assume is that there is at least one flat surface against which the workpiece may be pressed.

Confronting member 40 is mounted on base 20 adjacent work area A and rotatable about second axis C for biasing or holding a portion of the sheet metal against the base to fix its position relative thereto. Member 40 includes two generally elongate opposed wall portions 42 and 44. Wall portion 42 has a first end 42*a* and a second end 42*b* and wall portion 44 has a first end 44*a* and a second end 44*b*. Each wall portion, and specifically first ends 42*a* and 44*a* include apertures which are aligned with similar apertures in walls 22 and 24 and a standard combination of a bolt 43*a*, a washer 43*b*, and a nut 43*a* rotatably fastens, via the aligned apertures, each wall portion 42 and 44 to walls 22 and 24 respectively, thereby allowing the confronting member to be reciprocally moved relative to the base. Wall portion 42 includes a limiting aperture 42*c* adjacent first end 42*a* and a screw 42*d* is inserted through wall 22 and extends into aperture 42*c* to limit the range through which member 40 may be moved.

Stop structures 46 and 48, shown in FIG. 2, include protuberant shoulder portions 46*a* and 48*a* respectively, with each portion having a corresponding screw 46*b* and 48*b* upon which respective nuts 46*c* and 48*c* are screw threadedly received. The structures serve as adjustable stops and are provided on first ends 42*a* and 44*a* of wall portions 42 and 44, respectively. Second ends 42*b* and 44*b* of walls 42 and 44 are joined by a handle 50 having a section of rubberized material or foam 50*a* for gripping mounted thereon.

A press bar 52 is preferably made of hollow stainless steel and is welded to and joins wall portions 42 and 44 and includes plural axially-spaced screw bores, two of which are shown in dashed lines in FIG. 2 at 52*a* and 52*d*. A depending portion 54 in the form of a flattened bar having a generally rectangular shape includes plural apertures 54*a–h* and is adjustably mounted just beneath bar 52 by brackets 56 and 58. Dual springs 55*a* and 55*b* are conventionally mounted between press bar 52 and support bar 36 and bias the press bar and hence depending portion 54 away from support bar 36.

While bracket 56 will be described in detail below, it should be understood that bracket 58 is identical to and mounted in the same fashion as bracket 56. As shown in FIGS. 2–3, bracket 56 includes a first flattened surface 56*a*, a second flattened surface 56*b*, and a connector portion 56*c* therebetween which is generally orthogonal to first and second surfaces 56*a* and 56*b*. Both first and second flattened surfaces include apertures which assist in mounting depending portion 54 to bar 52. More specifically, bracket 56 is mounted at first flattened surface 56*a* to press bar 52 via knob 60 which has a non-rotatably joined screw portion 60*a* most easily seen in FIG. 3. The screw portion passes through the aperture in first flattened surface 56*a* as shown and is screwthreadedly received in any one of the screw bores 52*a–d* in press bar 52. Bracket 56 is mounted at its second flattened surface 56*b* to depending portion 54 via a bolt 64 passing through the aperture on the second flattened surface 56*b* and fastened down by a conventional wing nut 66. The combination of the plural spaced apertures 54*a–h* in depending portion 54 and the screw bores 52*a–d* in press bar 52 permit brackets 56 and 58 to be repositioned along press bar 52 to accommodate depending portions of varying lengths. This allows for sheet metal panels of varying widths to be worked upon by the tool. A rubberized pressing member 68 is mounted on the side of depending portion 54 nearest support bar 36.

Figure 4A:
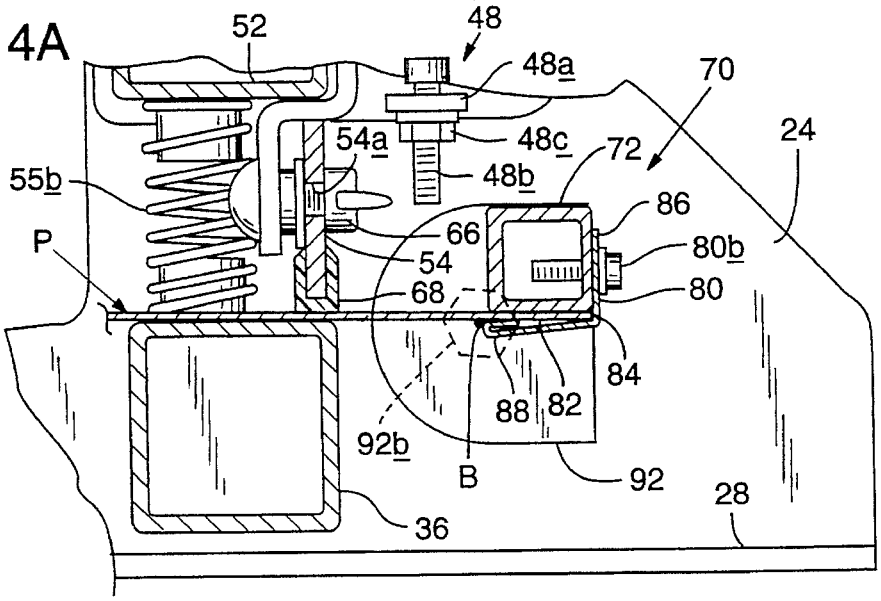
Figure 4B:
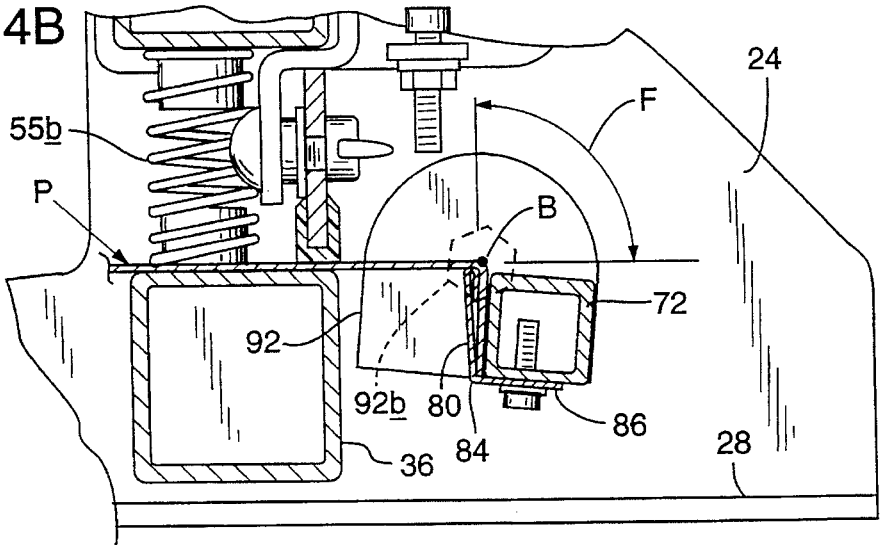
Figure 4C:
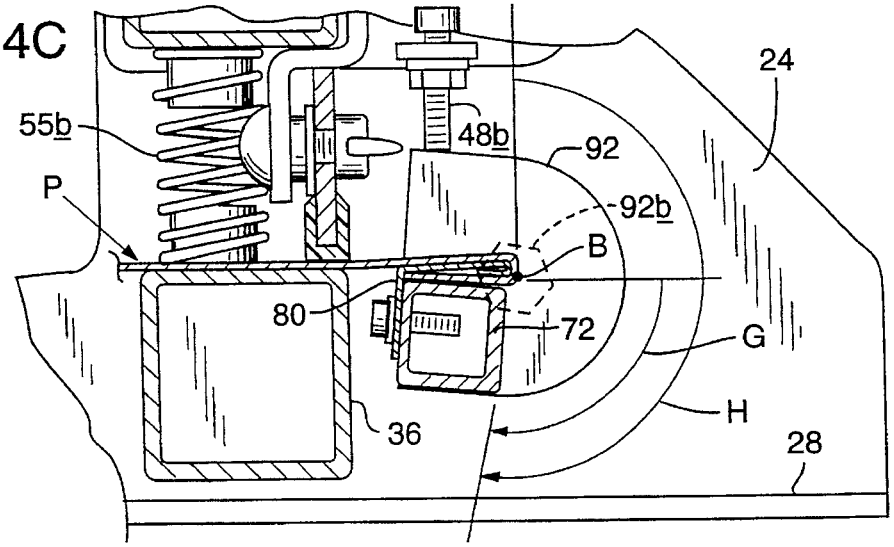

As shown in FIGS. 2–4, bending member 70 is preferably of tubular stainless steel and includes an elongate bar 72 having a first end 74 and a second end 76, with the bar rotatably mounted at each of its ends to base 20. Bar 72 is rotatable about axis B which is generally parallel to the long axis of the bar, and preferably has a generally square cross-section transverse the long axis thereof, most easily seen in FIGS. 4A–D.

A receiver 80 in the form of a rectangular metal plate is adjustably mounted to bar 72 by plural receiver screws 80*a–g*. Plate 80 as shown in FIGS. 4A–D, has a first section 86 which is mounted to bar 72 by screw 80*b* and includes slots 86*a* and 86*b*, and a second section 88 which is spaced slightly from bar 72, and includes subsections 88*a* and 88*b* at the distal end thereof. Together, second section 88 and bar 72 define a slot 82 which is generally parallel to the long axis of bar 72 as shown in FIG. 2. Plate 80 substantially conforms to the shape of bar 72 because of angled bend 0 at a portion 84 which is slightly more than 90°. The angled bend on the plate defines first section 86 and second section 88, and in the preferred embodiment a value for θ of around 95° has been found to work suitably well in the bending operation described below.

As shown in FIG. 4D, plate 80 has a first thickness $W_1$ measured at first section 86 along a line generally orthogonal to and through the surface thereof. Plate 80 has a second thickness $W_2$ formed by subsections 88*a* and 88*b* and measured along a line generally orthogonal to and through the surface thereof, which is generally greater than first thickness $W_1$. Subsection 88*b* and bar 72 define an adjustable slot width W which determines the gauge of metal which may be inserted therein. Preferably, the distal end of section 88 is formed by bending subsection 88*b* back against subsection 88*a* and crimping it down so that the differential thickness allows for the overbending or overbreaking of an end portion of a piece of sheet metal described in more detail below.

As shown in FIG. 2, bending member 70 and more specifically bar 72 includes cam structure joined adjacent each end. That is, first end 74 has non-rotatably joined thereto cam 90 and second end 76 has non-rotatably joined thereto cam 92. Cams 90 and 92 interpose bar 72 and ratchet structure 94 and 96, respectively and each includes a non-rotatably joined screw portion 90*a* and 92*a* respectively, with each screw portion having a nut 90*b* and 92*b* respectively, non-rotatably joined thereon.

As mentioned above, cams 90 and 92 interpose bar 72 and ratchet structure 94 and 96 respectively, in an operative arrangement which will be specifically described with reference only to ratchet structure 96 shown in FIG. 5. It should be understood however that both ratchet structures are identical and perform in the same manner described below.

Preferably, ratchet structure 96 includes a standard socket wrench 98 with a conventional ratcheting feature which allows bending in only one direction. Wrench 98 includes a head 108, a handle 110, and a socket 112 rotatably mounted on head 108. A generally cylindrical mounting boss 100 includes a first end 102 and a second end 104 which passes through an aperture in wall 24 of base 20. First end 102 has a circumference generally larger than the circumference of the aperture while second end 104 has a circumference generally smaller than the aperture. First end 102, by virtue of its larger circumference abuts wall 24 when boss 100 is inserted through the aperture. An elongate central bore 106 extends through boss 100 between first and second ends 102 and 104 respectively, and defines a passageway from the interior to the exterior of tool 10, and socket 112 passes through the bore to conventionally capture nut 92*b* on cam 92. At the other end of wrench 98, handle 110 is conventionally fixed in a hollow bar end 114 of U-shaped bar 116. Bar 116 joins both socket wrenches to allow for the manual rotation of the bar 72 and is provided with a pad 116*a* which may be gripped by a user.

Stop structure 48 and specifically the bottom of screw 48*b* prevents cam 92 from rotating about a certain range thereby defining the end of the overbreak during the bending operation described below.

IN OPERATION

Tool 10 of FIG. 1 may be used to uniformly bend an end portion of a sheet metal workpiece into what is known as a "J-hook," the shape of which is shown in FIG. 6A.

Most gauges of sheet metal have resilient qualities which cause the sheet metal to rebound when it is bent. Because of this, it has become common practice to over-bend or overbreak the sheet metal to give it a desired bend. By way of example, if a 90° bend is desired, the metal may have to be bent to 95°–100° to offset the metal's resiliency and give it the desired bend. Of course, the nature and extent of the metal's resiliency determines the amount of overbreak and because different gauges of metal have different resiliencies, the overbreak must be adjusted accordingly.

It has been found desirable in the roof industry to bend an end portion of a sheet metal roof panel in a 180° "J-hook" such as that shown in FIG. 6A, so that it may be installed beside other similarly bent roof panels each of which is fitted over what is known as a joggle cleat. As shown in FIGS. 6A-B, a single roof panel 200 has a "J-hook" 202 which has an area 204 which receives a joggle cleat 206. Joggle cleat 206 is affixed to a roof by conventional means and the roof panel is slid over the joggle cleat as shown and fastened to adjacent panels by suitable means.

The method of producing a 180° "J-hook" with tool 10 is depicted in FIGS. 1, 3, and 4A–D, and requires a workpiece P or P' (in the event a valley panel is to be worked upon) to be inserted into tool 10 to occupy work area A.

Whether bending regular roof panels or valley panels, tool 10 is equipped with a bending member 70 in the form of an elongate bar 72 which includes a receiver 80 defining an adjustable elongate slot 82 into which a piece of sheet metal, and more specifically an end portion thereof is inserted. Tool 10 accommodates different gauges of metal because receiver 80 is adjustable to calibrate for the differences. Specifically, by loosening receiver screws 80*a–g*, inserting a representative gauge of metal into slot 82 and thereafter tightening screws 80*a–g* into place, tool 10 may be configured and reconfigured for bending a variety of gauges of metal. As FIG. 4D shows, slots 86*a* and 86*b* allow for receiver 80 to be vertically repositioned when all of the receiver screws and particularly screw 80*b* are (is) loosened. Vertically repositioning receiver 80 either widens or narrows slot 82 and hence width W. By inserting a representative portion of metal into slot 82 and gently urging receiver 80 against bar 72, the proper slot width may be determined, and with receiver screws 80*a–g* in place, the user of tool 10 is guaranteed uniformity in each and every bend.

Once the tool has been calibrated for the proper gauge of metal, a workpiece is inserted into the tool for bending, with the end portion or leading edge inserted into slot 82. Confronting member 40 is biased against a portion of the workpiece by physically grasping handle 50 about foam 50*a* and moving the handle to overcome the force of springs 55*a* and 55*b* (shown in FIG. 2). Overcoming the bias of the springs brings depending portion 54 and more particularly pressing member 68 on press bar 52 against a portion of the workpiece to ensure that it remains flush or fixed against the tool during the bending operation described below. It is also possible for confronting member 40 to be normally spring-biased toward bar 36 so that the user must initially overcome the force of the springs to move the member away from the bar so that the workpiece may be inserted into work area A. Then by releasing the confronting member, the workpiece is automatically biased against the tool with no subsequent effort on the part of the user.

The former method of biasing confronting member 40 against a portion of the workpiece operation is shown in FIGS. 3 and 4A which depict a portion of sheet metal which has been inserted into tool 10. As shown in FIG. 3, confronting member 40 and specifically press bar 52 and depending portion 54 are as yet biased away from the sheet metal by the force of the springs, with only spring 55*b* shown. Moving handle 50 in the direction of arrow D to the position shown in dashed lines, moves the confronting member against the force of the springs, and brings press bar 52, depending portion 54, and pressing member 68 into contact with the sheet metal, as shown in FIG. 4A.

Manually moving bar 116 in the direction of arrow E in FIG. 3 to the position shown in dashed lines, rotates bar 72, receiver 80, and hence an end portion of the sheet metal in slot 82 about axis B thereby bending the end portion as shown in FIGS. 4B and C. In FIG. 4B, bar 72 has been rotated clockwise around 90° and through a first range F to bend the end portion of the sheet metal around 90°. Ratchet structure 94 and 96, most easily seen in FIG. 2, allows bar 116 to be recycled back about rotation axis B in a counter clockwise direction such that bar 72 remains substantially in the position shown in FIG. 4B. After recycling, bar 116 may again been moved in the clockwise direction (FIG. 3) to rotate bar 72 through a second range G in FIG. 4C, which is limited by stop structure 48 and cam 92, to finish the bending action. Of course, stop structure 46 and cam 90 similarly limit the extent to which bar 72 may be rotated about axis B.

Bar 116 may be recycled more than one time to accomplish the complete over-breaking of the end portion of the metal if necessary. Range H in FIG. 4C defines a range through which bar 72 is rotated during the overbreaking operation described above. But, because different gauges of metal possess different resiliency characteristics, it may be necessary to overbreak the workpiece more or less than shown in FIG. 4C. Stop structures 46 and 48 and more specifically screws 46*b* and 48*b* allow for this because they are adjustable upwardly or downwardly to engage cams 90 and 92 at different locations thereby either extending or reducing the bending range and hence the overbreak.

As discussed above, the 180° bend is imparted to the end portion by over-breaking the metal portion. Such overbreaking is accomplished by the bending member by virtue of subsections 88*a* and 88*b* on plate 80 most easily seen in FIG. 4D. The thicker width $W_2$ allows the end portion of the sheet metal, and specifically the leading edge thereof which is located near the rear of the slot, to be bent to a position which is closer to the remaining unbent sheet metal than the rest of the end portion received in slot 82. Thus, through overbreaking, the end portion of the sheet metal is given a "J-hook" substantially as shown in FIG. 6A. Further overbreaking of the metal may be accomplished by placing the "J-hook" under depending portion 54 and manually applying compressive force to the sheet metal via handle 50.

Although the invention may be used to impart bends of 180° or better to an end portion of a roof panel, it will be understood and appreciated by those of skill in the art, that the present invention has equally useful applications in other fields of endeavor in which it is desirable to bend sheet metal.

Because of the size and light-weight construction due to the hollow elements described above, tool 10 is very portable and may be used in a variety of environments where heavier tools would fail. Such environments include construction sites and roof tops, where the tool has particular utility because of its ability to completely bend an end portion of sheet metal 180° without requiring the handle to be moved through a similar range.

While the present invention has been shown and described with reference to the foregoing preferred embodiment, it is to be understood by those skilled in the art that other changes in form and detail may be made therein without departing from the spirit and scope of the invention as defined in the appended claims.

I claim:

1. A light-weight sheet metal bending tool for accommodating roof-top use in bending an end portion of a sheet metal work piece, the tool being capable of bending the end portion at least 180-degrees relative to the work piece, the tool comprising:

a base defining a sheet metal work area for receiving a generally planar sheet metal work piece;

a confronting member mounted on the base adjacent the work area and reciprocally movable relative thereto, for biasing a portion of the sheet metal work piece against the base, thereby fixing the position of the work piece relative to the base;

a bending member rotatably mounted to the base and spaced from the confronting member, wherein the bending member is rotatable about a rotation axis for bending the end portion of the sheet metal work piece; and a handle operatively connected to the bending member for articulation through a defined range for enabling a user to rotate the bending member about its rotation axis and impart a 180-degree bend in the end portion, wherein the defined range through which the handle may be moved lies above the work piece plane.

2. The tool of claim 1 wherein the bending member includes a receiver for receiving an end portion of the sheet metal and bending the end portion when the bending member is rotated about the rotation axis.

3. The tool of claim 1 wherein the bending member includes an elongate bar which is rotatable about the rotation axis.

4. The tool of claim 3 further comprising a handle joined to the bar for manually rotating the bar about the rotation axis.

5. The tool of claim 4 further comprising ratchet structure mounted between the handle and the bar for allowing bending in only one direction.

6. The tool of claim 4 wherein the handle is joined to each end of the bar.

7. The tool of claim 6 further comprising ratchet structure mounted between the handle and each end of the bar for allowing bending in only one direction.

8. The tool of claim 7 further comprising adjustable stop structure on the base and cam structure non-rotatably joined to each end of the bar interposing the bar and the ratchet structure, the stop structure for preventing the cam structure and thereby the bar from being rotated beyond a definable point.

9. A portable tool for imparting a 180-degree bend in an end portion of a sheet metal roof panel comprising:

a support base defining a work area for receiving and supporting a generally planar piece of sheet metal;

a confronting member mounted to the base adjacent the work area and reciprocally movable relative thereto, for holding the sheet metal against the base to prevent the metal from moving;

an elongate bending member rotatably mounted adjacent the base and spaced from the confronting member, the elongate bending member being rotatable about a first rotation axis which is generally parallel to the long axis thereof, the bending member for bending an end portion of the sheet metal; and a handle operatively connected to the bending member and movable through a defined range for moving the bending member about its rotation axis to a first position for bending the sheet metal end portion a defined amount, the handle being recyclable through the range while the bending member maintains the bent end portion in the first position so that the handle may again move the bending member about its rotation axis to a second position for further bending the end portion and imparting the 180-degree bend mentioned above, wherein such handle recycling occurs in an area substantially above the sheet metal.

10. The tool of claim 9 wherein the bending member includes a receiver for receiving an end portion of the sheet metal and bending the end portion when the bending member is rotated about the first rotation axis.

11. The tool of claim 10 wherein the bending member includes a bar rotatably mounted to the base and further wherein the receiver includes bending-member-shape-conformable structure mounted on the bending member, the structure defining a slot generally parallel to the long axis of the bar, the slot for accepting an end portion of the sheet metal and bending the same when the bar is rotated about the first rotation axis.

12. The tool of claim 11 wherein the bending-member-shape-conformable structure is adjustably mounted to the bar to vary the dimensions of the slot thereby accommodating different gauges of metal for bending.

13. The tool of claim 11 wherein the bar has a generally square cross-section transverse the long axis thereof, and wherein the bending-member-shape-conformable structure includes an elongate rectangular metal plate having an angled bend formed therein generally parallel to the long axis of the bar, the angled bend shaped to generally conform to a corner of the bar, the bend defining on the plate, a first section and a second section, the first section being mounted to the bar and the second section spaced from the bar to define a slot for receiving an end portion of the sheet metal.

14. The tool of claim 13 wherein the metal plate has a first thickness at its first section and a second thickness at a subsection of its second section, wherein the second thickness is generally greater than the first thickness, such first thickness being taken along a line generally orthogonal to the surface of the metal plate and through the first section, and such second thickness being taken along a line generally orthogonal to the surface of the metal plate at the subsection and through the subsection, wherein the subsection's greater thickness allows for the overbending of an end portion of the sheet metal.

15. The tool of claim 9 wherein the confronting member is rotatably mounted to the base and rotatable about a second axis.

16. The tool of claim 15 wherein the first and second rotation axes are generally parallel.

17. The tool of claim 9 wherein the confronting member is spring-biased against the base.

18. The tool of claim 9 wherein the confronting member includes a press bar and a handle attached thereto, the handle for manually moving the press bar against the sheet metal to hold it in place relative to the base.

19. The tool of claim 18 wherein the press bar includes an adjustable depending portion for accommodating different gauges of metal.

20. A method of forming about a 180° bend on an end portion of a piece of sheet metal comprising the steps of:

inserting a piece of sheet metal into a bending tool having a bending member with an elongate slot formed therein and a handle attached thereto, so that when the sheet metal is inserted, an end portion thereof is received in the slot in the bending member;

biasing a confronting member of the tool against a portion of the sheet metal to press that portion against the tool to keep it flush against the tool, such biasing occurring at a location spaced from the bending member; and manually rotating the handle and hence the bending member and sheet metal end portion about a defined rotation axis between the bending and confronting members, the handle being rotated through a defined range which lies substantially above the piece of sheet metal to overbreak the end portion more than 180° to give the end portion a bend of about 180°.

21. The method of claim 20 wherein the step of rotating the sheet metal includes the step of rotating the bending member about the rotation axis around 180° to overbreak the end portion of the sheet metal and give it a bend of about 180°.

22. The method of claim 21 wherein the steps of biasing the confronting member and rotating the bending member are manually performed.

23. The method of claim 22 wherein the step of bending the sheet metal further comprise the steps of:

(a) rotating the handle in a direction about the rotation axis and through a first range wherein such first range the handle and the bending member are rotated about the rotation axis thereby bending the end portion of the sheet metal;

(b) manually recycling the handle in the opposite direction about the rotation axis and through a second range, wherein such second range only the handle rotates about the rotation axis; and (c) repeating steps (a) and (b) to overbreak the end portion of the sheet metal more than 180° to give the end portion a bend of about 180°.

* * * * *